US009951959B2

(12) United States Patent
De Brosse et al.

(10) Patent No.: US 9,951,959 B2
(45) Date of Patent: Apr. 24, 2018

(54) HOME APPLIANCE WITH IMPROVED BURNER

(71) Applicant: BSH Home Appliances Corporation, Irvine, CA (US)

(72) Inventors: Richard De Brosse, Lafollette, TN (US); Timothy Russell, Jacksboro, TN (US); Ben Braden, Lafollette, TN (US); Jeremiah Nash, Knox, TN (US)

(73) Assignee: BSH Home Appliances Corporation, Irvine, CA (US)

( * ) Notice: Subject to any disclaimer, the term of this patent is extended or adjusted under 35 U.S.C. 154(b) by 345 days.

(21) Appl. No.: 14/135,658

(22) Filed: Dec. 20, 2013

(65) Prior Publication Data

US 2015/0176845 A1 Jun. 25, 2015

(51) Int. Cl.
*F24C 3/08* (2006.01)
*F23D 14/06* (2006.01)
*F23D 14/64* (2006.01)

(52) U.S. Cl.
CPC ..... *F24C 3/085* (2013.01); *F23D 14/06* (2013.01); *F23D 14/64* (2013.01); *F23D 2213/00* (2013.01); *F23D 2900/14042* (2013.01)

(58) Field of Classification Search
CPC ..... F23D 2900/14042
USPC ..... 126/39 E; 122/26
See application file for complete search history.

(56) References Cited

U.S. PATENT DOCUMENTS 4,123,898 A * 11/1978 Diels ..... G04B 1/08 368/179
4,414,077 A * 11/1983 Yoshida ..... C25D 11/12 204/DIG. 9
4,430,168 A * 2/1984 Gazapo Santa-Olalla ..... C25D 11/22 205/153
5,266,026 A * 11/1993 Riehl ..... F23D 14/06 126/39 E
6,065,467 A * 5/2000 Martin ..... A47J 37/0713 126/100
6,089,219 A * 7/2000 Kodera ..... F23D 14/065 126/39 H
6,142,143 A * 11/2000 Martin ..... F24B 1/1808 126/200
6,217,725 B1 * 4/2001 Van Anglen ..... C25D 17/008 204/207
6,379,523 B1 * 4/2002 Takabayashi ..... C25D 11/08 205/173
6,439,881 B2 * 8/2002 Haynes ..... F23D 14/06 431/278

(Continued)

FOREIGN PATENT DOCUMENTS

JP 60014005 A * 1/1985

*Primary Examiner* — Jorge Pereiro

(74) *Attorney, Agent, or Firm* — Michael E. Tschupp; Andre Pallapies; Brandon G. Braun

(57) ABSTRACT

A home appliance having an improved burner including an appliance body; at least one burner assembly supported in the appliance body to provide a heat source, the burner assembly including a burner head, an electrode and a venturi tube for mixing gas and air and directing the resultant gas and air mixture to the burner head for ignition by the electrode and flame output through the burner head, the venturi tube being formed from a material subjected to an electrolytic passivation process, preferably an anodizing process.

20 Claims, 10 Drawing Sheets

(56) References Cited

U.S. PATENT DOCUMENTS 6,439,882 B2 * 8/2002 Haynes ..... F23D 14/06 431/278
6,884,336 B2 * 4/2005 Kia ..... C25D 11/04 205/324
7,122,107 B2 * 10/2006 Kia ..... C25D 5/50 205/173
7,732,068 B2 * 6/2010 Levendusky ..... C23C 18/122 148/256
7,980,599 B2 * 7/2011 Schindel ..... F16L 37/28 285/277
8,430,431 B2 * 4/2013 Schindel ..... F16L 37/28 205/151
8,464,703 B2 * 6/2013 Ryu ..... F23D 14/06 126/39 E
8,580,101 B2 * 11/2013 Darcy ..... C25D 11/22 205/139
8,841,590 B2 * 9/2014 Cheng ..... A47J 36/02 219/121.64
8,845,326 B2 * 9/2014 Shaffer ..... F23D 14/06 126/39 E
8,899,972 B2 * 12/2014 Fowler ..... F23D 14/06 126/39 E
9,173,527 B2 * 11/2015 Ulrich ..... A47J 43/282
9,187,839 B2 * 11/2015 Sheehy ..... C25D 11/04
9,334,577 B2 * 5/2016 Kock ..... C23C 22/56
2001/0041316 A1 * 11/2001 Haynes ..... F23D 14/06 431/278
2002/0001786 A1 * 1/2002 Haynes ..... F23D 14/06 431/278
2007/0257484 A1 * 11/2007 Schindel ..... F16L 37/28 285/93
2009/0061216 A1 * 3/2009 Levendusky ..... C23C 18/122 428/336
2009/0061218 A1 * 3/2009 Levendusky ..... C23C 18/00 428/336
2011/0143295 A1 * 6/2011 Fowler ..... F23D 14/06 431/285
2011/0233922 A1 * 9/2011 Schindel ..... F16L 37/28 285/33
2011/0236840 A1 * 9/2011 Vaglica ..... F24C 3/103 431/264
2013/0032599 A1 * 2/2013 Musil ..... C25D 3/30 220/573.1
2014/0232019 A1 * 8/2014 Kieswetter ..... B23B 1/00 261/19
2015/0090373 A1 * 4/2015 Gable ..... C22F 1/053 148/549
2015/0173222 A1 * 6/2015 Demers ..... G06F 1/16 312/223.1
2015/0275333 A1 * 10/2015 Tameda ..... C22C 9/04 251/368

* cited by examiner

HOME APPLIANCE WITH IMPROVED BURNER

BACKGROUND OF THE INVENTION

The present invention is related broadly to home appliances that employ a heat-generating apparatus and, more particularly, to home appliances that use gas burners as a controlled heat source.

Home appliances such as ranges and cooktops may use gas burners as a source of heat for cooking. Cooking appliances that may employ gas burners include freestanding ranges that include an oven and a cooktop as well as built-in cooktops. With respect to the present invention, references herein to ranges, cooktops, built-in cooktops and hobs may be used interchangablely and all may act as a platform for gas burner use. In addition, while the present application focuses on ranges and cooktops, the invention described herein may have applicability with other appliances employing heat such as laundry dryers and the like.

Gas burners utilize a gas supply such as natural gas or propane mixed with air to provide a combustible gas/air mixture which is directed to a burner head for ignition by an electrode. A user-controlled valve throttles the amount of gas available for the burner head to thereby control the amount of heat energy applied by the burner flame to a cooking vessel on the cooktop.

Air and gas is mixed and delivered to the burner head for combustion by a venturi which is generally a metal cylindrical element that has a bore extending therethrough with a constriction in the bore. Within the venturi bore, the velocity of the fluid increases as the cross section of the bore decreases, with the static pressure correspondingly decreasing. As the gas/air mixture go through the constriction, the gas/air mixture accelerates and the pressure is reduced at the constriction, causing the acceleration. Proper venturi operation results in a tight blue flame that is controllable with the throttle valve.

Generally, venturis for gas burners may be formed from brass. However, brass has been shown to have some disadvantages when employed as a material for a burner venturi. Brass becomes discolored after extended operation at elevated temperatures present in cooking operations and can be difficult to machine to desired dimensions. Further, brass can be both expensive and heavy. In their favor, brass venturis are generally dimensionally stable.

Therefore, there is a need for a burner venturi that is formed from a material other than brass that can provide at least the performance characteristics of brass.

SUMMARY OF THE INVENTION

It is accordingly the intention of the present invention to provide a home appliance with an improved burner that will provide a venturi that maintain key dimensions within a predetermined tolerance under heavy use and will maintain its appearance under such heavy use.

In accordance with one preferred embodiment of the present invention, a home appliance having an improved burner includes an appliance body, at least one burner assembly supported in the appliance body to provide a heat source. The burner assembly includes a burner head, an electrode and a venturi tube for mixing gas and air and directing the resultant gas and air mixture to the burner head for ignition by the electrode and flame output through the burner head. The venturi tube is formed from a material subjected to an electrolytic passivation process.

Preferably, the electrolytic passivation process is an anodizing process. It is further preferred that the venturi is formed from aluminum.

Preferentially, the venturi is formed from aluminum and the electrolytic passivation process is an anodizing process.

In addition, it is preferred that the venturi is subjected to a colorizing process. Preferably, the colorization process is performed during the electrolytic passivation process.

It is preferred that the venturi is formed from aluminum, the electrolytic passivation process is an anodizing process and the venturi is subjected to a colorizing process.

Preferably, the electrolytic passivation process results in a treated surface extending to a predetermined depth. Further, it is preferable that the treated surface extends to a depth of between about 0.00040 inches (0.01041 mm) to about 0.00146 inches (0.03708 mm). It is further preferred that the treated surface extends to a depth of between about 0.00079 inches (0.02007 mm) to about 0.00086 inches (0.02184 mm). In addition, it is preferred that the treated surface extends to a depth of between about 0.00040 inches to about 0.00070 inches (0.01778 mm) inches The present invention is also effective in a range, stove, built-in cooktop, oven or hob. To that end, the present invention is directed to a cooktop having an improved burner including a cooktop body. At least one burner assembly is supported in the cooktop body to provide a heat source. The burner assembly includes a burner head, an electrode and a venturi tube for mixing gas and air and directing the resultant gas and air mixture to the burner head for ignition by the electrode and flame output through the burner head. The venturi tube is formed from a material subjected to an electrolytic passivation process.

Preferably, the electrolytic passivation process is an anodizing process. It is further preferred that the venturi is formed from aluminum.

In addition, it is preferred that the venturi is formed from aluminum and the electrolytic passivation process is an anodizing process.

Preferably, the venturi is subjected to a colorizing process. It is also preferred that the colorization process is performed during the electrolytic passivation process.

It is further preferred that the venturi is formed from aluminum, the electrolytic passivation process is an anodizing process and the venturi is subjected to a colorizing process a colorizing process.

Preferentially, the electrolytic passivation process results in a treated surface extending to a predetermined depth. Further, it is preferable that the treated surface extends to a depth of between about 0.00040 inches (0.01041 mm) to about 0.00146 inches (0.03708 mm). Preferably, the treated surface extends to a depth of between about 0.00079 inches (0.02007 mm) to about 0.00086 inches (0.02184 mm). It is further preferred that the treated surface extends to a depth of between about 0.00040 inches to about 0.00070 inches (0.01778 mm) inches.

DESCRIPTION OF THE PREFERRED EMBODIMENT

Figure 1:
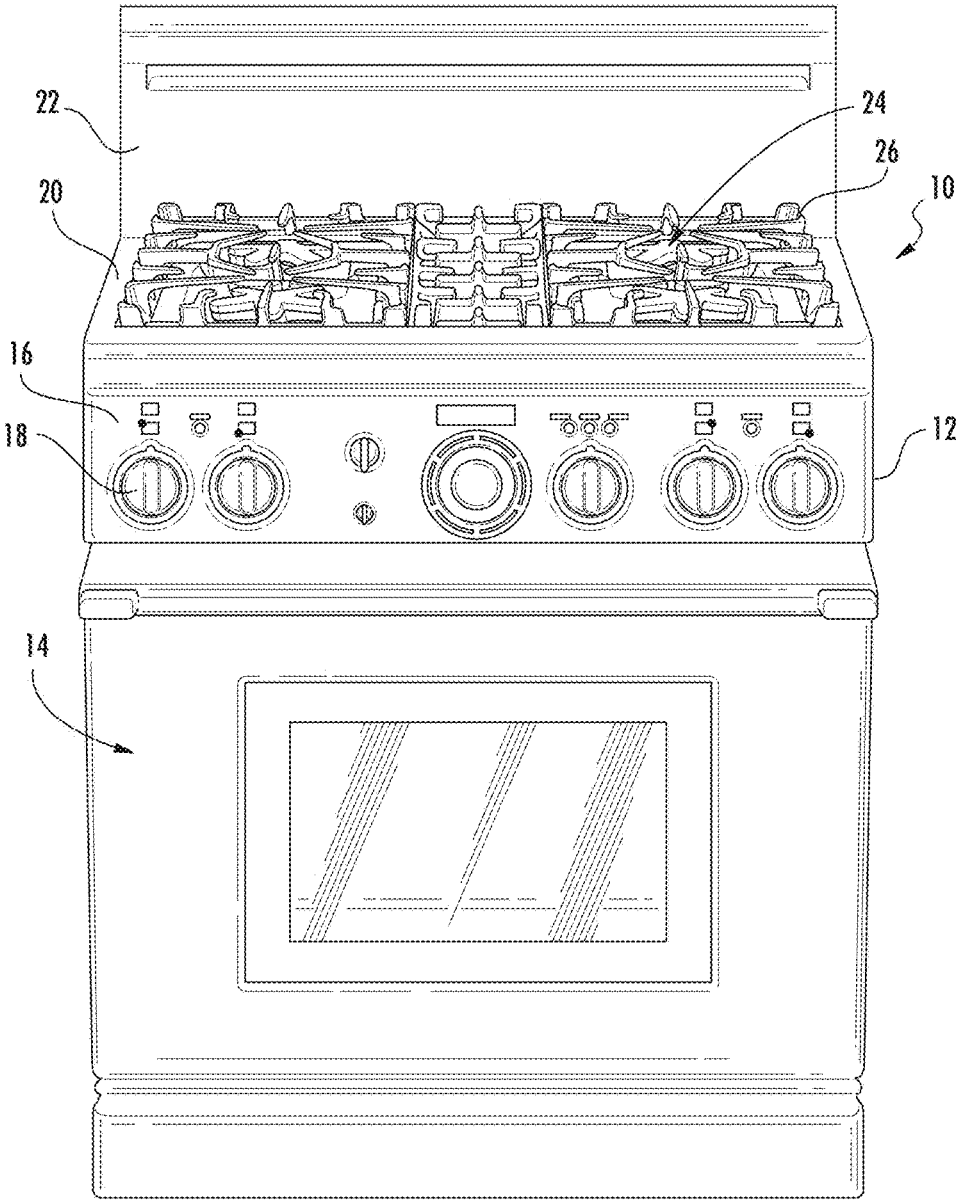
FIG. 1 is a front view of a home appliance in the form of a range, having an improved burner according to one preferred embodiment of the present invention.

Turning now to the drawings and, more particularly to FIG. 1, a home appliance in the form of a range is illustrated generally at 10 and includes a generally rectangular, floor-standing range body 12 housing an oven 14 and a cooktop 20. The oven 14 defines an internal cooking cavity covered by an access door. The cooktop 20 is above the oven and provides a generally horizontal cooking surface. A vertically oriented backsplash 22 extends upwardly from the rear portion of the cooktop 20 and a control panel 16 extends downwardly from the front portion of the cooktop 20 toward the oven 14. A series of control knobs 18 is arranged linearly across the control panel 16 and is provided for user control of the range functions such as oven heating and burner operation.

A plurality of burners 24 is arranged on the cooktop 20. The range illustrated in FIG. 1 includes four burners 24 but, depending upon the chosen configuration, the number of burners can vary, usually from two to six. Each burner 24 is covered by a skeletal grate 26 which provides support for a cooking vessel over a respective burner. The skeletal grates 26 expose part of the surface of the cooking vessel to the controlled cooking flame emitted from the burners.

Figure 2:
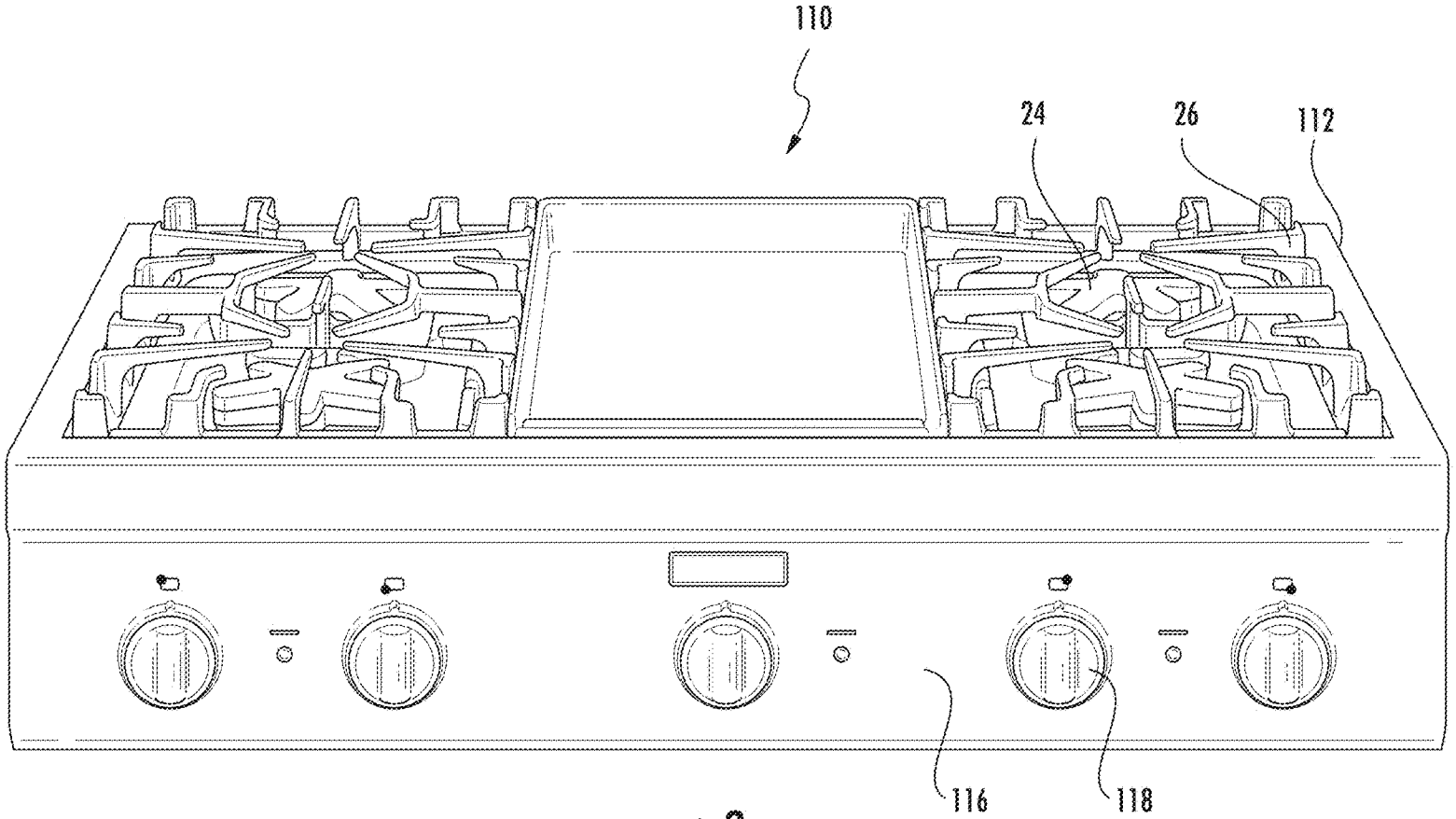
FIG. 2 is a front perspective view of a built-in cook top having an improved burner in accordance with another preferred embodiment of the present invention.

Turning now to FIG. 2, a built-in cooktop is illustrated at 110 and includes a control panel 116 similar to the control panel on the range 10 illustrated in FIG. 1. In addition, control knobs 118 are provided on the control panel 116 in a manner similar to the range 10. Such built-in cooktops 110 separate the hob and the oven, however both cooktops 20, 110 perform essentially the same function of supporting cooking vessels for the controlled application of cooking heat. Accordingly, the built-in cooktop 110 includes burners 24 covered by grates 26.

Figure 3:
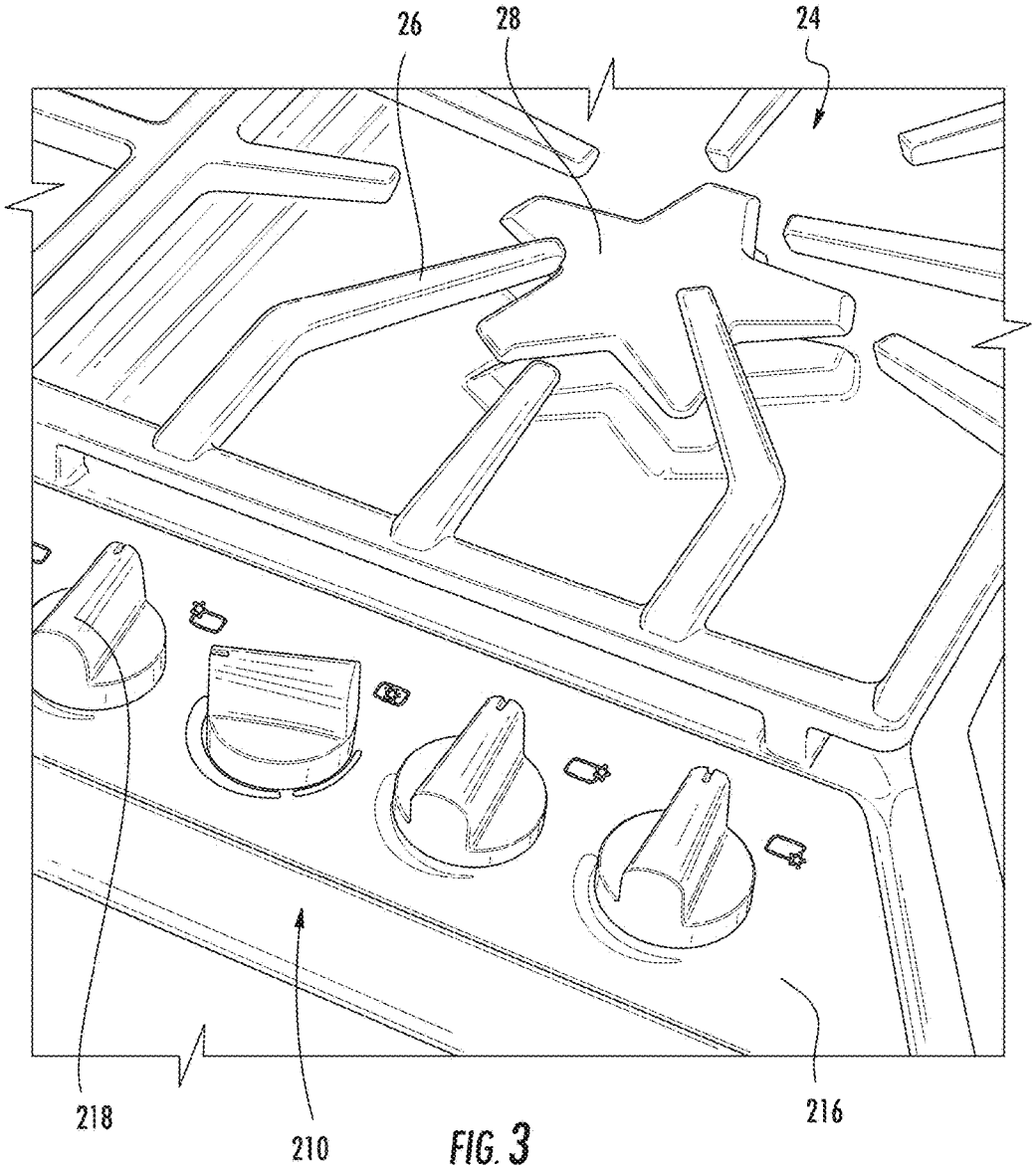
FIG. 3 is a front view of a burner according to one preferred embodiment of the present invention.

FIG. 3 provides a closer view of the relationship between the burner 24 and the grates 26. It should be noted in FIG. 3 that the control panel 216 is in the same horizontal plane as the cooktop 210 unlike the range 10 and the cooktop 110 illustrated in FIG. 1 and, respectively. Such design distinctions have no bearing on the structure of the present invention but allow more versatility in kitchen design.

Figure 4:
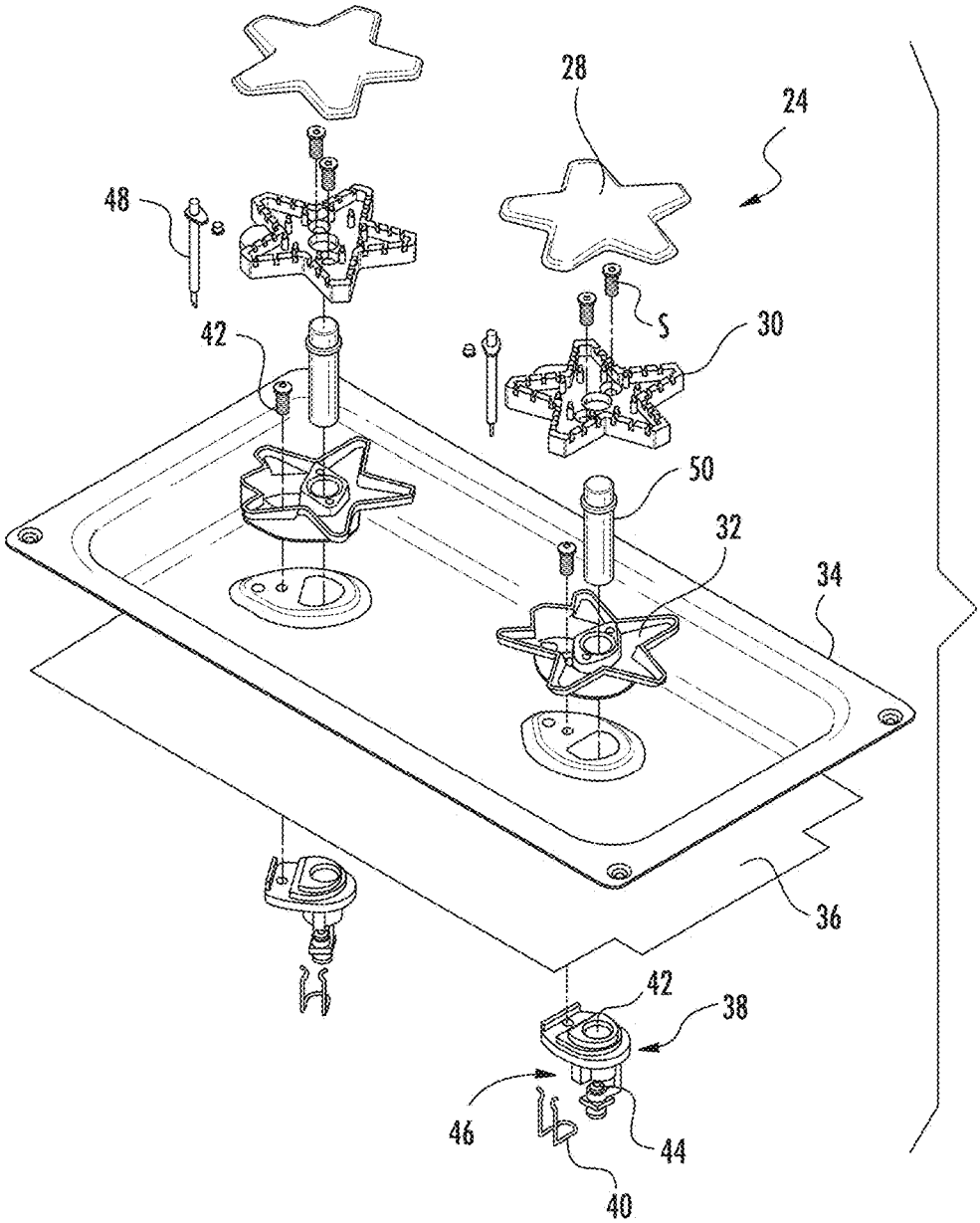
FIG. 4 is an exploded view of two burners according to a preferred embodiment of the present invention.

FIG. 4 offers an exploded view of a burner structure. Although FIG. 4 illustrates two burners 24, both burners 24 are essentially the same and are housed in a common hob top 34. The hob top 34 is a shallow, generally rectangular metal pan that fits into the cooktop framework of either a built-in cooktop or a range and provides a mounting location for the burners 24. The burners and oven are isolated from one another by a generally planar heat shield 36 under the hob top 34.

Each burner 24 includes a burner base 32 mounted to the hob top 34 with screws S. The burners 24 illustrated in FIG. 4 have a generally five-pointed star shape while other burners (not shown) may have other shapes such as rectangular, square or as is most common, circular. All such burners operate according to the same principle, yet the star-shaped burner provides more even flame coverage, and therefore more even heat application, across the bottom of a cooking vessel.

A burner head 30 is mounted to the burner base 32 and includes a series of ports along the star-shaped perimeter for flame passage. Each burner 24 has a star-shaped burner cap 28 applied thereto. The burner cap 28 in combination with the burner base 30 defines a combustion chamber and helps to direct the flame outwardly thought the ports. An electrode 46 is mounted to the burner head for controlled ignition of the gas/air mixture during burner operations.

The gas/air mixture is provided to the burner head 30 from a jet holder 38 that is held to the underside of the hob top 34 by a clip 40. The jet holder 38 includes a bore 42 and a jet 44 positioned below the bore 42. The bore 42 is open on its underside around the jet 38 to define an air intake 46. An electrode 48 is mounted to the burner head 30 and provides a regulated, pulsing spark for ignition of the combustible mixture.

A venturi 50 extends from the jet 44 and air intake 46 through the bore 42 in the jet holder 38 and upwardly through openings in the burner base 32 and the burner head 30, with the venturi tube 50 emptying into the burner head 30.

In general operation, the jet 44 directs gas into the venturi 50 where the gas mixes with air from the air intake 46 to form a combustible gas/air mixture. By the effect of the venturi 50, air is drawn into the air intake 48 and, given a properly operating venturi, is mixed with gas and the resultant combustible mixture is expelled into the burner head 30 for combustion.

Proper combustion, and therefore effective cooking operation of the appliance, depends on several factors including the integrity of the gas supply and proper mixing of air and gas in the venturi 50. With proper operation of the pulsing electrode, the resultant flame burns blue and evenly from the ports around the perimeter of the burner head 30. Clean burning flame generally leaves a clean burner assembly and if the flame is not clean burning due, for example, to a faulty gas/air mixture, deposits can form which can ultimately have a detrimental effect on venturi performance, and, by extension, appliance performance.

Not only is cleanliness important, dimensional stability of the venturi itself is also important to maintain the proper gas/air mixture. Brass venturis are generally dimensionally stable under a sever heat load, but aluminum venturis tend to become distorted under a heat load and can degrade performance of the appliance and become difficult to extract for replacement.

Another aspect of venturi performance is the outward appearance of the venturi itself. As will be seen in greater detail hereinafter, the current state of the art brass venturis, while dimensionally stable, become discolored under a heat load and can give the appearance that they may be failing which could result the unnecessary expense of replacing a venturi where the problem blamed on the venturi may actually lie elsewhere.

Figure 5:
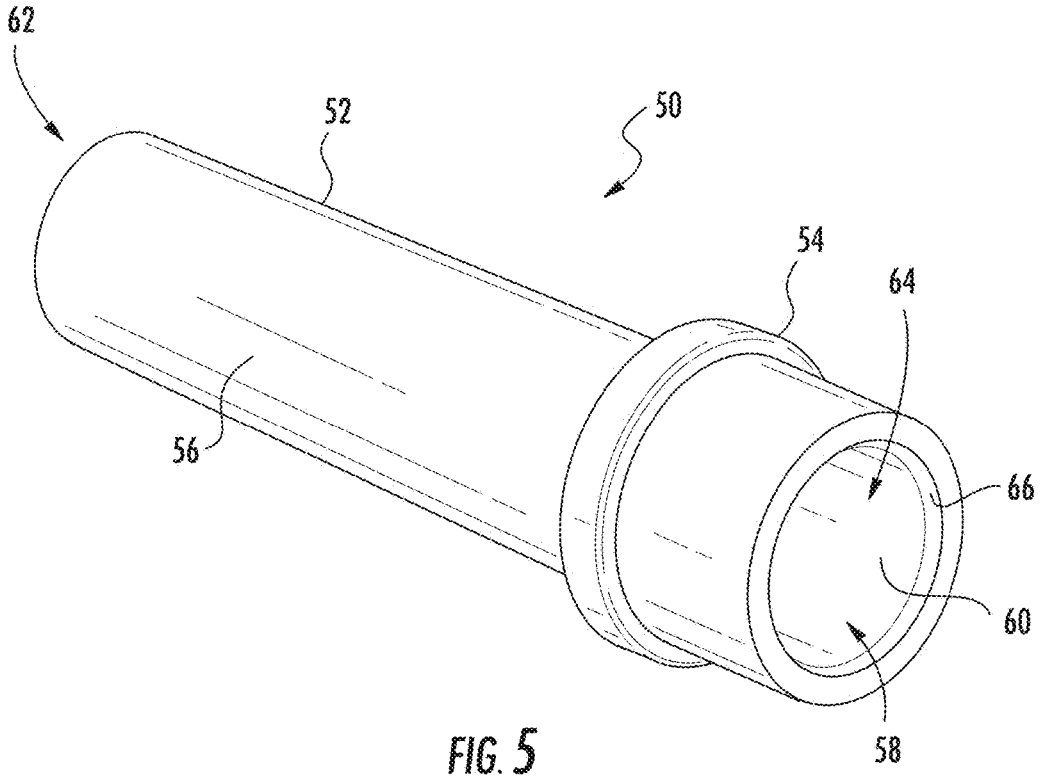
FIG. 5 is a perspective view of a venturi according to the preferred embodiment of the present invention.
Figure 6:
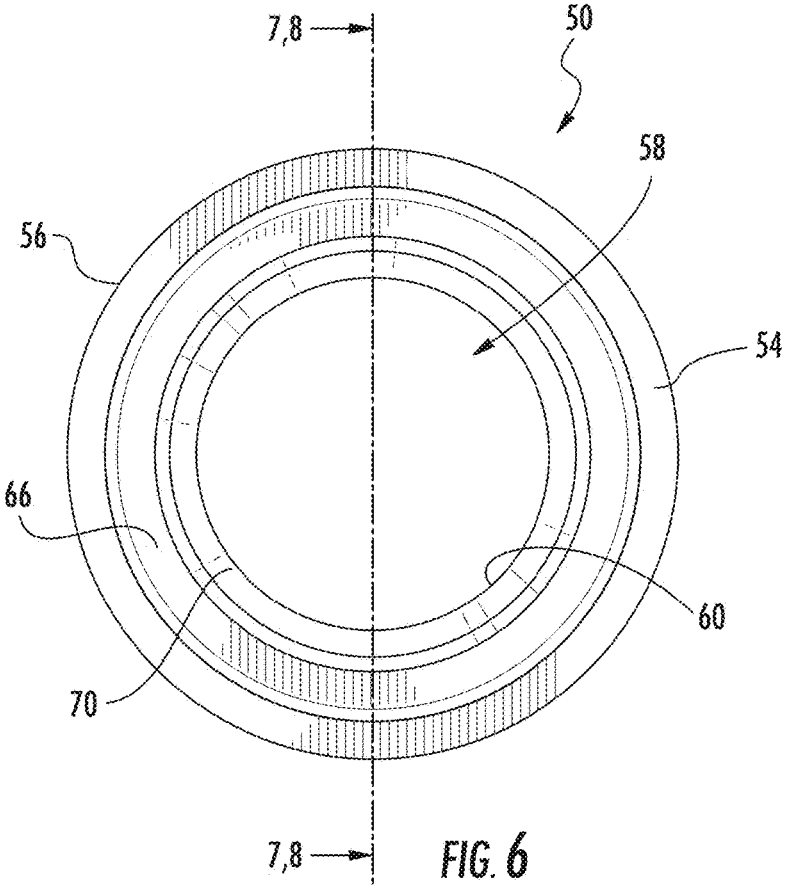
FIG. 6 is a front view of the venturi illustrated in FIG. 5.
Figure 7:
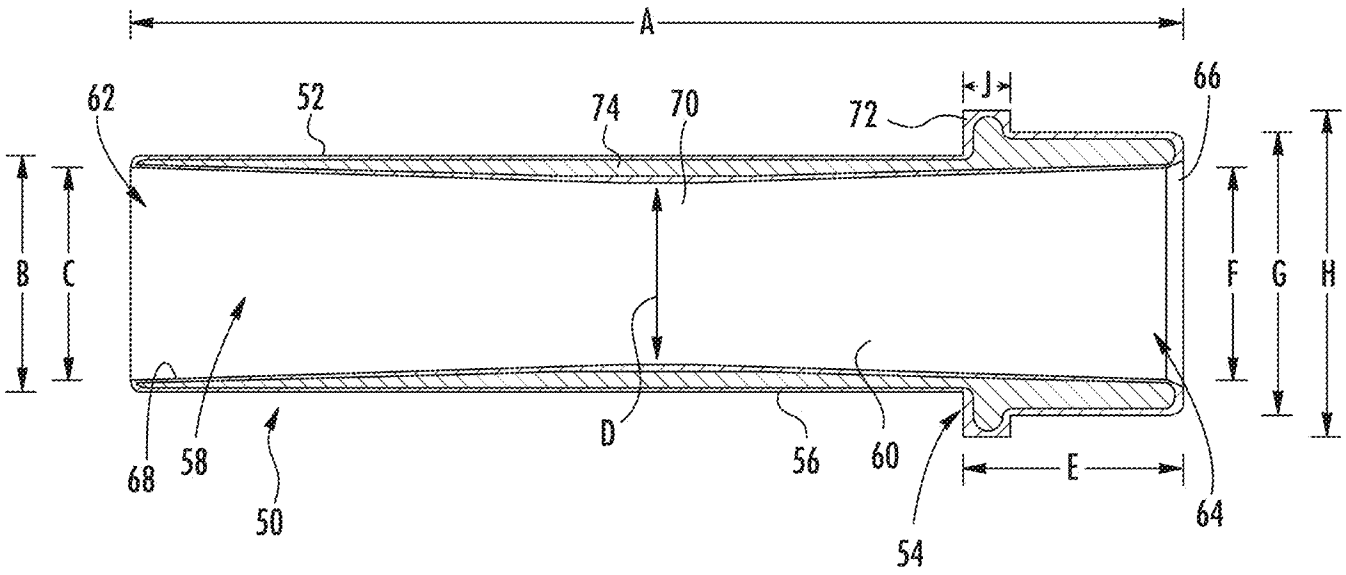
FIG. 7 is a cutaway view of a venturi according to one preferred embodiment of the present invention, taken through line 7,8 of FIG. 6.

Turning now to FIGS. 5, 6, and 7, a venturi, according to one preferred embodiment of the present invention is illustrated at 50 and includes a venturi body 52 which is formed as a hollow, elongate cylinder or tube, open at both ends, and defining a bore 58 extending therethrough. The venturi body 52 is a solid metallic structure formed from a single aluminum billet prior to treatment, having an inter surface 60 within the bore 58 and an outer surface 56. The venturi body 52 defines an inlet 62 at one end of the bore 58 and an outlet 64 at the other end of the bore 58. The outlet 64 includes an outlet cone 66 which helps to control distribution of the gas/air mixture passing through the bore 58. Similarly, an inlet cone 68 is formed at the inlet 62 of the bore 58.

The venturi body 52 includes a mounting shoulder 54 formed as a flange extending around the body 52 and projecting outwardly therefrom. The mounting shoulder 54 is positioned near the outlet 64. With reference to FIG. 4, the mounting shoulder 54 acts to position the venturi 50 on the burner base 32 for stable distribution of the gas/air mixture in the burner head 32. FIG. 7 illustrates the internal structure of the bore 58 including an inlet cone 68 formed at the inlet 62 and an outlet cone 66 formed at the outlet 64. As with all venturis, a central constriction 70 provides the venturi effect.

Referring to FIG. 7, the venturi 50 is shown in cross section after having been subjected to an electrolytic passivation process, preferably anodizing. Anodizing is an electro-chemical process involving an electrolytic bath that converts a metal surface into an anodic oxide finish. The anodic oxide finish structure originates from the aluminum substrate and is composed entirely of aluminum oxide. In contrast to a coating applied to a surface such as painting or plating, the aluminum oxide surface is fully integrated with the underlying aluminum substrate. It has a highly ordered, porous structure that allows for secondary processing such as the colorizing process discussed herein. The anodizing process results in a treatment area illustrated at 72 extending over the underlying aluminum substrate 74.

With reference to FIG. 7, dimensions for the venturi are given below in Table 1. Dimensions are in mm and the tolerance is +/−0.20 mm:

TABLE 1

| Dimension | Value |
|---|---|
| A | 72.00 |
| B | 16.15 |
| C | 14.50 |
| D | 12.50 |
| E | 15.00 |
| F | 14.40 |
| G | 19.10 |
| H | 22.20 |
| J | 3.20 |

Figure 8:
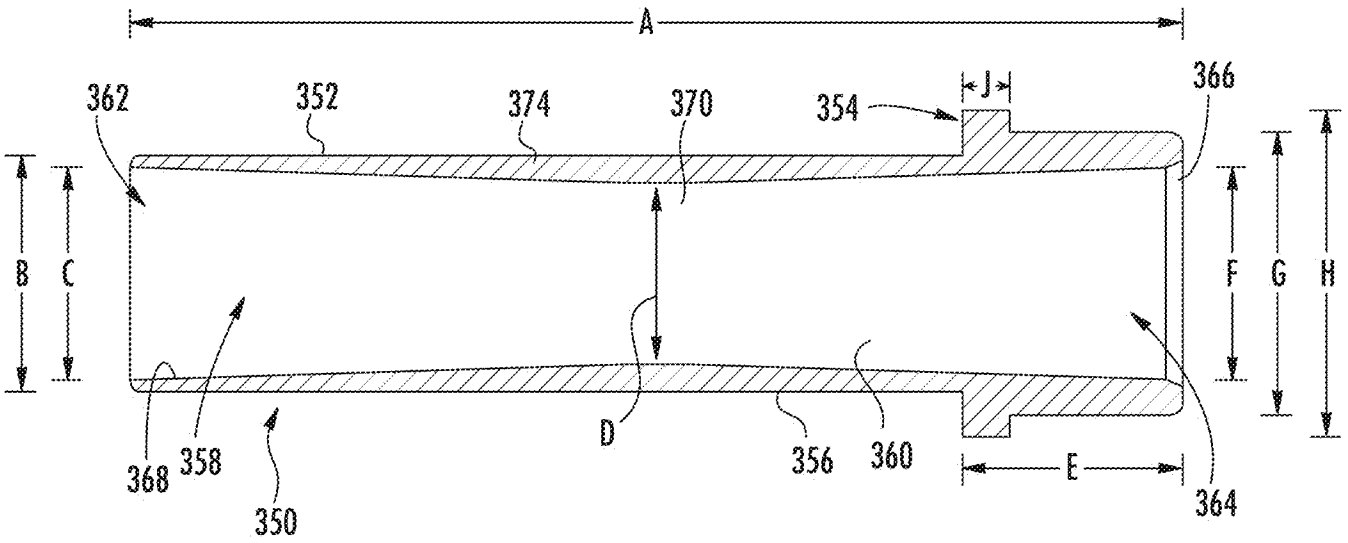
FIG. 8 PRIOR ART
FIG. 8 is a cutaway view of a venturi, according to the prior art, taken through line 7,8 of FIG. 6.

FIG. 8 illustrates an untreated brass venturi with reference numerals corresponding to the aluminum counterparts of FIG. 7. FIG. 8 depicts a cutaway view of a brass venturi 350 according to the prior art, taken through line 7, 8 of FIG. 6. The brass venturi 350 has a venturi body 352 with an inlet 362, an outlet 364 and a bore 358 extending between the inlet 362 and the outlet 364. The outlet 364 defines an outlet cone 366, while the inlet defines an inlet cone 368. The venturi body 352 includes an outer surface 356 and an inner surface 360. A mounting shoulder 354 is formed on the outer surface 360 integrally with the venturi body 352. As with the aluminum version, a constriction area 370 provides the venturi effect. As can be seen, the entire body of the brass venturi 350 defines an untreated area 374. Dimensions A-H and J are the same dimensions as those associated with the aluminum venturi 50.

During anodizing process, several venturi tubes according to the present invention may be processed at once with multiple venturi tubes placed on a rack are submerged together in the electrolytic process bath, in the present case a sulfuric acid bath. A cathode is submerged in the bath and the aluminum venturis become the anodes. During the process, the anodic film is built and combined with the metal by passing electric current through the acid electrolyte bath in which the aluminum is immersed. The anodic film is formed in a controlled manner to thereby provide a treatment region extending to a predetermined depth. Due to the various dimensions of the venturi, the depth may not uniform and can vary within predetermined ranges. The present venturi is treated to result in the surface treatment 72 extending to a depth of between about 0.00040 inches (0.01041 mm) to about 0.00146 inches (0.03708 mm). Other value ranges of treatment depth are feasible and could be applied. These include about 0.00079 inches (0.02007 mm) to about 0.00086 inches (0.02184 mm) and a depth of about 0.00040 inches to about 0.00070 inches (0.01778 mm) inches.

During the anodizing process, the venturi 50 is subjected to a colorizing process in order to provide the aluminum venturi with the appearance of brass. The color is applied as a dye during the anodizing process. The dye is water based and is applied in a dye tank. After the color is applied, a nickel acetate seal coat is applied.

Aluminum has a coefficient of thermal expansion of 12.3 $10^{-6}$ in/in ° F. brass has a coefficient of thermal expansion of 10.4 $10^{-6}$ in/in ° F. The lower coefficient of thermal expansion of brass indicates that aluminum will undergo greater thermal expansion than brass, under the same conditions. As may be expected, if certain dimensional stability is not maintained, poor venturi performance can result as well as the possibility of not being able to extract the venturi from the burner head when necessary for venturi replacement.

It was initially questionable whether aluminum in any form could be used as an effective venturi, however unexpected results were achieved. To determine the thermal operating characteristics of a venturi subjected to an anodizing process, a test unit was configured from a six-burner range. Half the burners were equipped with brass venturis and half the burners were equipped with anodized aluminum venturis according to the present invention. Each burner had two insulating firebricks to minimize heat loss. Each firebrick measured 9×4.5×2.5 inches and each weighed approximately 2½ pounds, with the 9 by 4.5 side down over each burner completely covering the grate. All six burners were operated simultaneously, with all burners having their respective control valves set to a maximum output for 1 hour, then off for a 30 minute cooling period. This was repeated for 100 cycles, resulting in 100 hours of operating at a high setting. With the cooktop covered with insulating firebrick, the heat could not easily escape and the cooktop received most of the heat produced. During the test burner venturi temperatures reached approximately 800° F. The result of this is that hot air was cycled through the venturi and mixed with gas for combustion, placing a greater load on the venturi material that might normally be encountered during cooking operations. The treatment area on the test venturi extends to about 0.00146 inches (0.03708 mm).

Combustion testing revealed that although there were some permanent dimensional changes, the surface burners still operated within tolerance with respect to the burner operating characteristics and products of combustion, with particular interest given to carbon monoxide production.

With reference to FIG. 7, select dimensions before the test are given below in Table 2, where A1, A2 and A3 refer to measured values for aluminum venturis 1-3, and B1, B2 and B3 refer to measure values for brass venturis 1-3. All standard tolerance is +/−0.20 mm.

TABLE 2

| Dimension | Standard | A1 | A2 | A3 | B1 | B2 | B3 |
|---|---|---|---|---|---|---|---|
| B | 16.15 | 16.14 | 16.16 | 16.15 | 16.12 | 16.16 | 16.15 |
| C | 14.50 | 14.48 | 14.49 | 14.51 | 14.41 | 14.52 | 14.48 |
| G | 19.10 | 19.08 | 19.07 | 19.06 | 19.09 | 19.08 | 19.10 |
| H | 22.20 | 22.20 | 22.10 | 22.20 | 22.19 | 22.14 | 22.21 |

With reference to FIG. 7, select dimensions after the test are given below in Table 2, where A1, A2 and A3 refer to measured values for aluminum venturis 1-3, and B1, B2 and B3 refer to measure values for brass venturis 1-3. All standard tolerance is +/−0.20 mm.

TABLE 3

| Dimension | Standard | A1 | A2 | A3 | B1 | B2 | B3 |
|---|---|---|---|---|---|---|---|
| B | 16.15 | 16.40 | 17.00 | 16.24 | 16.36 | 16.36 | 16.24 |
| C | 14.50 | 14.68 | 14.50 | 14.51 | 14.65 | 14.51 | 14.54 |
| G | 19.10 | 19.50 | 19.46 | 19.39 | 19.31 | 19.25 | 19.43 |
| H | 22.20 | 22.73 | 22.60 | 22.56 | 22.26 | 22.27 | 22.35 |

It can be seen that with the present AL venturi, some dimensions were out of tolerance after the test, including B (A1 and A2), G (A1-A3) and H (A1-A3). However, critical dimension C remained in tolerance, which was unexpected. This means that the venturi could be extracted from its mounting location, even after the expansion resulting from the test. All of the brass venturi dimensions remained in tolerance, except for G (B3).

Figure 9:
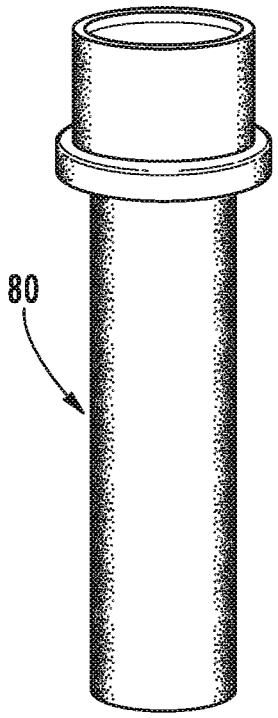
FIG. 9 PRIOR ART
FIG. 9 is a photographic front view of a prior art venturi tube after testing.
Figure 10:
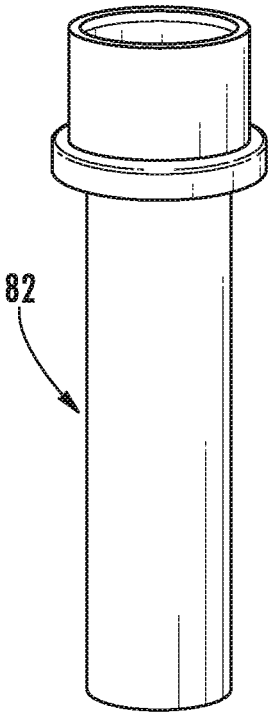
FIG. 10 is a front photographic view of the venturi of FIG. 5 after testing.

The colored anodized aluminum is proven to not only undergo acceptable thermal expansion, the appearance of the present venturi is vastly superior to the appearance of a brass venturi having undergone the same test. FIG. 9 illustrates a prior brass venturi at 80 after 70 hours of testing, which was part of the 100 hour test described above. In substantial contrast, FIG. 10 illustrates a venturi according to the present invention at 82 after undergoing 70 hours of the same test. It can readily be seen that the prior venturi 80 has discolored and achieves a dull uneven finish, whereas the present venturi 82 hardly looks used at all.

Accordingly, the present invention provides a robust venturi that can withstand rigorous use while maintaining acceptable dimensional tolerance under heavy use. The present invention therefore extends the performance life of the burner as well as enhancing the appearance of the venturi portion of the burner, thereby making detection of a faulty venturi tube a much more straightforward process than is currently experienced.

It will therefore be readily understood by those persons skilled in the art that the present invention is susceptible of a broad utility and application. While the present invention is described in all currently foreseeable embodiments, there may be other, unforeseeable embodiments and adaptations of the present invention, as well as variations, modifications and equivalent arrangements, that do not depart from the substance or scope of the present invention. The foregoing disclosure is not intended or to be construed to limit the present invention or otherwise to exclude such other embodiments, adaptations, variations, modifications and equivalent arrangements, the present invention being limited only by the claims appended hereto and the equivalents thereof.

We claim:

1. A home appliance having an improved burner comprising:

an appliance body;

at least one burner assembly supported in the appliance body to provide a heat source, the burner assembly including a burner head, an electrode and a venturi tube for mixing gas and air and directing the resultant gas and air mixture to the burner head for ignition by the electrode and flame output through the burner head, the venturi tube being formed from an aluminum billet and subjected to an electrolytic passivation process including an anodizing process in an acid-based bath; a colorization process using a water-based dye in a dyeing tank; and a sealing process involving application of a nickel acetate coating, wherein the processed aluminum venturi tube has a thin treated surface and the appearance of a brass venturi tube.

2. A home appliance according to claim 1 wherein the electrolytic passivation process results in a treated surface extending to a predetermined depth.

3. A home appliance according to claim 2 wherein the treated surface extends to a depth of between about 0.00040 inches to about 0.00146 inches.

4. A home appliance according to claim 3 wherein the treated surface extends to a depth of between about 0.00079 inches to about 0.00086 inches.

5. A home appliance according to claim 2 wherein the treated surface extends to a depth of between about 0.00040 inches to about 0.00070 inches.

6. The home appliance according to claim 1 wherein the venturi tube has a venturi body with an exterior that is cylindrical.

7. The home appliance according to claim 6 further comprising a mounting shoulder formed as a flange extending around the venturi body and the mounting shoulder is located near an outlet end of the venturi body.

8. The home appliance according to claim 6 wherein the venturi body has inlet that has a diameter.

9. The home appliance according to claim 8 wherein the tolerance of the diameter is +/−0.20 mm during thermal expansion.

10. The home appliance according to claim 1 wherein the venturi tube has an inlet that has a bore formed therethrough and the bore having an inlet diameter that is configured to remain within tolerance after use.

11. A cooktop having an improved burner comprising:

a cooktop body;

at least one burner assembly supported in the cooktop body to provide a heat source, the burner assembly including a burner head, an electrode and a venturi tube for mixing gas and air and directing the resultant gas and air mixture to the burner head for ignition by the electrode and flame output through the burner head, the venturi tube being formed from an aluminum billet and subjected to an electrolytic passivation process including an anodizing process in an acid-based bath; a colorization process using a water-based dye in a dyeing tank; and a sealing process involving application of a nickel acetate coating, wherein the processed aluminum venturi tube has a thin treated surface and the appearance of a brass venturi tube.

12. A cooktop according to claim 11 wherein the electrolytic passivation process results in a treated surface extending to a predetermined depth.

13. A cooktop according to claim 12 wherein the treated surface extends to a depth of between about 0.00040 inches to about 0.00146 inches.

14. A cooktop according to claim 13 wherein the treated surface extends to a depth of between about 0.00079 inches to about 0.00086 inches.

15. A cooktop according to claim 12 wherein the treated surface extends to a depth of between about 0.00040 inches to about 0.00070 inches.

16. The cooktop according to claim 11 wherein the venturi tube has a venturi body with an exterior that is cylindrical.

17. The cooktop according to claim 16 further comprising a mounting shoulder formed as a flange extending around the venturi body and the mounting shoulder is located near an outlet end of the venturi body.

18. The cooktop according to claim 16 wherein the venturi body has inlet that has a diameter.

19. The cooktop according to claim 18 wherein the tolerance of the diameter is +/−0.20 mm during thermal expansion.

20. The cooktop according to claim 11 wherein the venturi tube has an inlet that has a bore formed therethrough and the bore having an inlet diameter that is configured to remain within tolerance after use.

* * * * *